US005196762A

United States Patent [19]

Go

[11] Patent Number: 5,196,762

[45] Date of Patent: Mar. 23, 1993

[54] ELECTRON GUN FOR COLOR PICTURE CATHODE-RAY TUBE WITH HEXAGONAL CROSS-SECTION

[75] Inventor: Nam J. Go, Gumi, Rep. of Korea

[73] Assignee: Goldstar Co., Ltd., Seoul, Rep. of Korea

[21] Appl. No.: 845,801

[22] Filed: Mar. 9, 1992

Related U.S. Application Data

[63] Continuation of Ser. No. 459,295, Dec. 29, 1989, abandoned.

[30] Foreign Application Priority Data

Dec. 30, 1988 [KR] Rep. of Korea ..... 7874/88

[51] Int. Cl.[5] ..... H01J 29/62

[52] U.S. Cl. ..... 313/414; 313/409

[58] Field of Search ..... 313/414, 409

[56] References Cited

U.S. PATENT DOCUMENTS 4,370,592 1/1983 Hughes et al. ..... 313/414

B1 4,370,592 8/1984 Hughes et al. ..... 313/414

4,535,266 8/1985 Say ..... 313/414

4,622,491 11/1986 Izumida et al. ..... 313/414

4,626,738 12/1986 Gerlach ..... 313/414

4,766,344 8/1988 Say ..... 313/414

4,887,009 12/1989 Bloom et al. ..... 313/414

*Primary Examiner*—Donald J. Yusko

*Assistant Examiner*—John Guist

*Attorney, Agent, or Firm*—Birch, Stewart, Kolasch & Birch

[57] ABSTRACT

An electron gun for a color picture cathode-ray tube which includes a main focusing lens of a large diameter for reducing deterioration of the focusing property caused by the spherical aberration of the main focusing lens, shortening the distances among three electron beams to minimize the deflection aberration from deflection yoke and making feasible a design for effective enlargement of the lens diameter even with the shortening of the distances among the three electron beams in the color picture cathode-ray tube requiring a good focusing property of the three beams.

2 Claims, 3 Drawing Sheets

Fig.2 (B) PRIOR ART

ELECTRON GUN FOR COLOR PICTURE CATHODE-RAY TUBE WITH HEXAGONAL CROSS-SECTION

This application is a continuation of application Ser. No. 07/459,295 filed on Dec. 29, 1989, now abandoned.

BACKGROUND OF THE INVENTION

1. Field of the Invention

The present invention relates to an electron gun for a color picture cathode-ray tube (hereinafter "CRT") for reducing deterioration of focusing property, minimizing deflection aberration from deflection yoke, and improving focusing property.

2. Description of the Prior Art

Generally, conventional electron guns are utilized in an electrostatic focusing system. An electrostatic focusing lens of the electrostatic focusing system placed between a first accelerating and focusing electrode and a second accelerating and focusing electrode closely focuses the beams from the electron beam forming region consisting of cathodes and a number of electrodes in front of the cathodes. The performance of such electrostatic lens depends on the difference of focusing force between the near-axis region and the maximum outer angle region, causing the spherical aberration of the lens. The larger the lens diameter is, the lesser the spherical aberration becomes.

In order to obtain a good electron beam focusing property for an electron gun for the color picture CRT, the electron beam through-holes of the first and second accelerating and focusing electrodes are preferred to be as large as possible.

FIGS. 1, 2(A), 2(B), and 3 show a conventional electron gun for a color picture cathode-ray tube. Such conventional electrode gun includes a first accelerating and focusing electrode 8 and a second accelerating and focusing electrodes.

The first accelerating and focusing electrode 8 and the second accelerating and focusing electrodes 9 form an electrostatic lens. Each of the electrodes 8 and 9 has an open end on one side and a oblong-shaped closed end and the two closed ends face each other. The closed end 13 of the electrode 8 and the closed end 14 of the electrode 9 connected to respective end walls 11 and 12, respectively are provided with three through-holes 11*a* and 12*a*, 11*b* and 12*b*, and 11*c* and 12*c* for passing electron beams. The through-holes have a rimmed lip extending from the closed end faces, respectively.

In the focusing electrodes 8 and 9, the upper walls 11 and 12 have 6 mm in height (hereinafter "H"), the lips 15 and 16 have 1.2–3.5 mm h, the electron beam holes have 5.5–5.9 mm in diameter (hereinafter "D"), and the distance between the adjacent holes is 6.6–6.9 mm. However, the above measurements are subject to the limitation of the optimum diameter 29.1 mm of the tube neck in a conventional color picture CRT.

The first and second focusing electrodes 8 and 9 are also arranged, as shown in FIG. 1, for the first focusing electrode 8 to be connected with its open end to a third grid electrode 7. The electron gun for the color CRT basically includes a cathode 4 fixed to a cathode support 2, first, second and third grid electrodes 5, 6, and 7, and the first and second accelerating and focusing electrodes 8 and 9 wherein they are arranged in a pile in the above mentioned order and fixed to a pair of bead glass 10.

In a conventional color picture CRT shown in FIG. 1, a heater 3 welded to a support 1 and inserted into the cathode 4, heats the cathode 4 and make it emit heated electrons. The third grid electrode 7 having an elongated cylindrical configuration and positioned in front of the first and second grid electrodes 5 and 6 connects to the first accelerating and focusing electrode. The first and second accelerating and focusing electrodes 8 and 9 constitute an electrostatic focusing lens, that is a bipotential focus (hereinafter "BPF").

The first and second accelerating and focusing electrodes 8 and 9 may be utilized in an electron gun including a plurality of additional electrodes disposed in the third grid electrode 7.

According to the conventional electron gun for the CRT, the electrons emitted from the cathode 4 by the heating of the heater 3 form an electron beam. The electron beam passes through the first grid electrode 5, the second grid electrode 6 and the third grid electrode 7 and enters the electrostatic focusing lens formed between the first and the second focusing electrodes 8 and 9. The received electron beams are closely focused to reach the fluorescent screen of the CRT and form a beam spot. The beam spot formed on the screen should have a high density in a round form in the least possible area.

However, in the first and second accelerating and focusing electrodes 8 and 9 for forming an electrostatic focusing lens of the electron gun shown in FIG. 2, the beam spot is distorted into a laterally oblong shape under the influence of the electrostatic focusing lens diameter. The diameter is restricted by the limited holes 11*a*–11*c* and 12*a*–12*c* for passing electron beams. Furthermore, the beam spot is distorted the deflection aberration caused by a deflection yoke. Therefore, the beam spot has a low density which deteriorates the resolution of the color picture CRT as a disadvantage.

For example, as shown in FIG. 3, the electrodes 8 and 9 for constituting an electrostatic focusing lens are housed in a tube neck 17 having an optimum diameter of 29 mm for the CRT. The thickness (b) of the rims respectively surrounding three beam through-holes in the closed end face of the first focusing electrode 8 has to be 1 mm in actual structure. Therefore, their relation is expressed by the following formula (I):

$$D \leqq S-1 \qquad \text{(I)}$$

Furthermore, the distance (a) between the inner wall of the tube neck 17 and the outer end walls 11 and 12 of the focusing electrodes requires to be 1 mm, their relationship being expressed by the following formula (II):

$$D \leqq R-(2a)-2(S+b) \qquad \text{(II)}$$

wherein R is the inner diameter of the tube neck, approximately 24 mm.

Therefore, the diameter is represented by the following formula (III):

$$D \leqq 20-2S \qquad \text{(III), and}$$

Dmax = 6 mm and Smax = 7 mm result from the formulas (I) and (III).

The conventional first and second focusing electrodes 8 and 9 form merely an electrostatic focusing lens of 6 mm at the maximum in diameter. Therefore, the small diameter of the focusing lens increases the spherical aberration, that is, the difference in focusing force between the near-axis region and the maximum outer angle region in the lens forms beam spots with a low density on the screen.

Also, because of the round shape of the electrostatic focusing lens, the beam spot with a low beam density distorts into a laterally oblong shape by the deflection aberration of deflection yoke to and further deteriorates the resolution of the color picture CRT. The known art concerning the lateral distortion of electron beams by the deflection aberration of deflection yoke will be omitted.

Besides, in order to obtain a better concentration of three electron beams for focusing three beam spots to gather a small converging area on the image screen, the distance S between adjacent beam holes is required to be smaller, but the conventional art gives 7 mm of S at the maximum under the limitation of the maximum lens diameter of 6 mm from the formulas (I) and (III). Accordingly, it is an disadvantage that the large distance S between the holes brings deterioration of the concentrating property of the CRT.

SUMMARY OF THE INVENTION

Accordingly, it is an object of the present invention to provide an improved electron gun for a color picture CRT, which can be shortened the distance among electron beams and yet effectively enlarge the lens diameter without changing the distance among the beams even when the first and second focusing electrodes for the electrostatic focusing lens are housed in a restricted tube neck so as to eliminate the disadvantages of the conventional art.

Another object of the present invention is to provide an electron gun construction which includes a slanted enlarging electrode provided with a laterally oblong hole having openings through which three beams jointly pass together. The openings are formed at the opposite faces of the first and second focusing electrodes and surrounded by respective rims extending from the end walls. A longitudinally oblong hole through which three beams pass, has a distance from the end rim so that the laterally oblong hole and the longitudinally oblong hole form a perpendicularly oblong hole.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an electron gun for a color picture cathode-ray tube, which includes a main focusing lens having a large diameter for reducing deterioration of the focusing property, short distances among three electron beams for minimizing the deflection aberration from deflection yoke and a feasible design for effective enlargement of the lens diameter disposed in the color picture cathode-ray tube so as to achieve a better focusing property of the three beams.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2(B) is a top plan view of the first accelerating and focusing electrode of FIG. 1;

DESCRIPTION OF THE PREFERRED EMBODIMENTS

Figure 1:
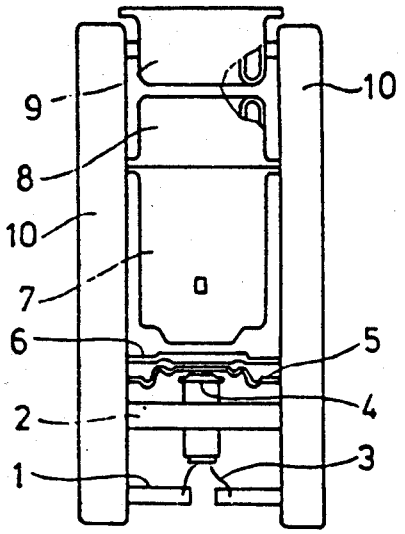
Fig.1 PRIOR ART
FIG. 1 is an elevational view of the conventional electron gun for the color picture CRT containing cut away portions in order to illustrate the construction of basic components thereof.
Figure 2A:
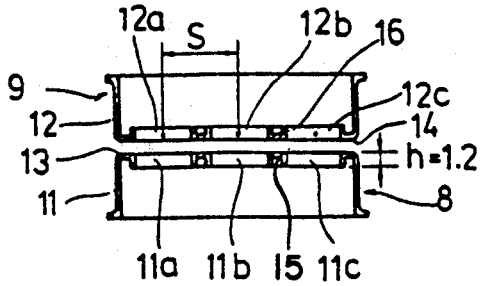
Fig.2(A) PRIOR ART
FIG. 2(A) is an sectional view of FIG. 1 showing the main electrostatic focusing lens including a first accelerating and focusing electrode and a second accelerating and focusing electrode.
Figure 2A:
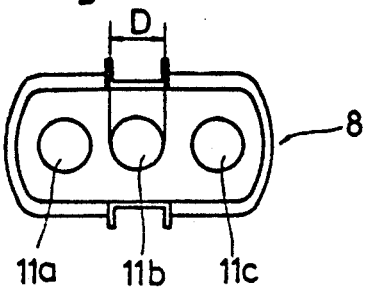
Fig.2(A) PRIOR ART
Figure 3:
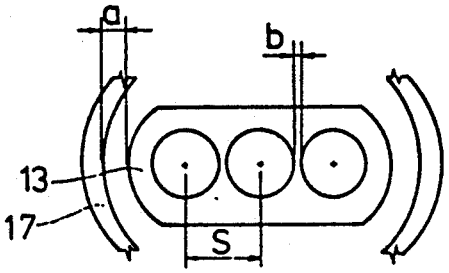
Fig.3 PRIOR ART
FIG. 3 is a sectional view of the electrode of FIG. 2(B) showing the electrode placed within the tube neck of the color picture CRT.
Figure 4A:
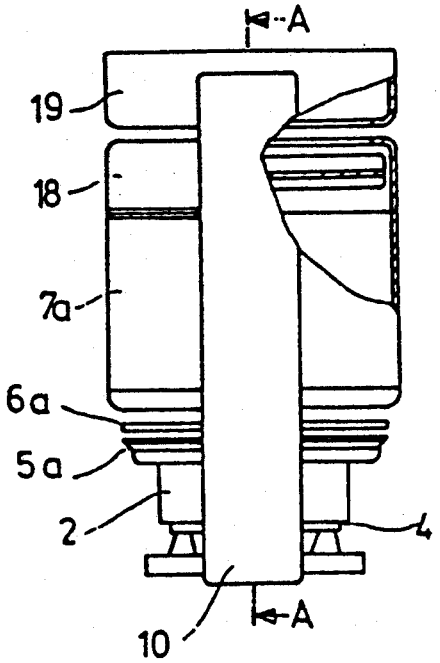
FIG. 4(A) is a front elevational view of the electron gun for the color picture CRT according to the present invention containing cut away portions in order to illustrate the construction of basic components of the present invention.
Figure 4B:
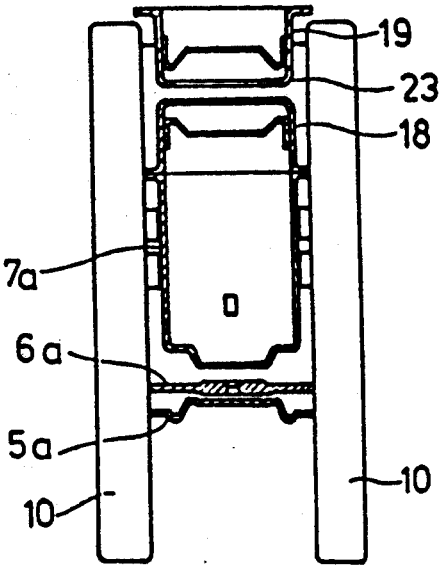
FIG. 4(B) is a sectional view of FIG. 4(A), taken along line A—A.

Referring now in detail to the drawings for the purpose of illustrating preferred embodiments of the present invention, the electron gun for the color picture cathode-ray tube as shown in FIGS. 4(A) and 4(B), includes a cathode 4 fixed to a support 2, a first grid electrode 5*a*, a second grid electrode 6*a*, a third grid electrode 7*a*, a first accelerating and focusing electrode 18 and a second accelerating and focusing electrode 19 wherein they are arranged in a pile in the above-mentioned order and fixed to a pair of bead glasses 10.

Figure 5A:
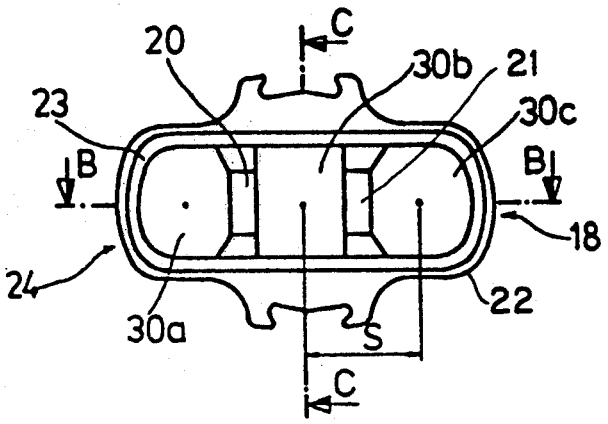
FIG. 5(A) is a top plan view of the first accelerating and focusing electrode for the electrostatic lens according to the present invention.
Figure 5:
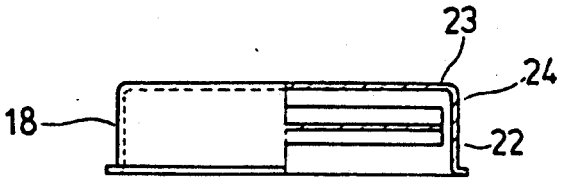
FIG. 5(B) is a sectional view of FIG. 5(A), taken along line B—B.
FIG. 5(C) is a sectional view of FIG. 5(A), taken along line C—C.
Figure 5:
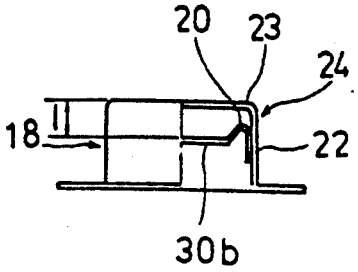

The first and second accelerating and focusing electrodes 18 and 19 are shown in FIG. 5(A). That is, the first accelerating and focusing electrode 18 is fully open at one side thereof and is provided at the other side thereof, with a slanted enlarging electrode 20 disposed on the interior of an oblong cylindrical electrode 24 which has an opening surrounded by an upper rim 23 extending from an outer end wall 22.

Figure 6A:
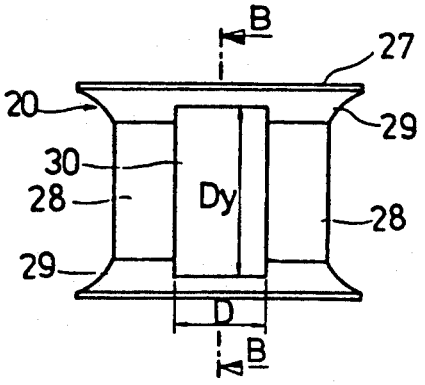
FIG. 6(A) is a top plan view of the slanted enlarging electrode disposed on the side of the first accelerating and focusing electrode according to the present invention.
Figure 6B:
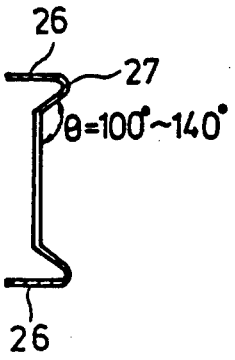
FIG. 6(B) is a sectional view of FIG. 6(A), taken along line B—B.

Also, as shown in FIGS. 6(A) and 6(B), the slanted enlarging electrode 20 is provided with connecting parts 26 formed at both ends thereof with same angle. The connection parts 26 extend to a head 27 and bend inward and form slopes 29 connected to a bottom portion 28. Three oblong holes 30*a*, 30*b*, and 30*c* are disposed from the bottom to the slopes 29 for passing beams through the holes.

The slanted enlarging electrode 20 as shown in FIG. 5(A) has the electron beam holes 30*a*, 30*b*, and 30*c* wherein the distance S between the hole centers of the beam holes is in the range of 5.1 mm–6.6 mm. The angle $\theta$ of inclination from the head 27 to the bottom portion 28 is in the range of 100–140 degree as shown in FIG. 6(B). The electrode 20 is disposed on the inner end wall 22 of the oblong shaped electrode 24 wherein the distance from the rim 23 of the electrode 24 to the bottom of the electrode 20 is in the range of 1.5–3 mm as shown in FIG. 5(C).

Also, referring to the oblong electron beam holes 30*a*, 30*b*, and 30*c* as shown in FIG. 5(A), the central hole 30*b* has a ratio 2:1 for the longitudinal length to the lateral width, and the holes 30*a* and 30*c* respectively having an approximate ratio 4:3 for the same directional measurements.

Furthermore, due to optimum limitation of the tube neck of 29.1 mm, for the lateral width of the open end surrounded by the upper rims 23 of the focusing electrodes 18 and 19 determines approximately 8 mm and the longitudinal diameters of the oblong holes 30*a*, 30*b*, and 30*c* of the electrode 20 also is set approximately at 8 mm.

In the arrangement of the focusing electrodes 18 and 19, the open end of the electrode 18 connects to the third grid electrode 7*a*, and the space disposed at the opposite rim 23 plays the function of an electrostatic focusing lens. Although the above description was made concerning solely an electron gun having a BPF lens, the present invention may be employed for an electron gun having multistaged connections with addition of a plurality of electrodes disposed at the position of the third grid electrode 7*a*.

According to the present invention, the electron gun operates as follows:

The oblong opening surrounded by the upper rim 23 extending from the outer end wall 22 of the oblong cylindrical electrode 24 of the first and second acceleration and focusing electrodes 18 and 19 forms a common beam hole for passing three electron beams therethrough as a common electrostatic focusing lens.

The above arrangement means that even through the shortest width of the oblong opening is about 8 mm due to the limitation of the tube neck, the size thereof shows an expansion of 1.45 times based on the diameter of 5.5 m of the conventional electron beam hole. It is to indicate the reduction of the spherical aberration by an approximate factor of 0.33 and the reduction of the lens force by an approximate factor of 0.69.

If the dimension of the electrostatic lens enlarges by a ratio of M, the derivative of the second order to the dislocation potential in the electrostatic lens reduces by $1/M^2$, because results are the lens force $A=1/M$ . . . (4) and the lens spherical aberration $C=1/M^3$ . . . (5).

Consequently, the electrostatic focusing lens formed by the first and second focusing electrodes 18 and 19 according to the present invention not only greatly reduces the spherical aberration of the lens but also reduces the magnification of the lens by its weak function such that small beam spots of high density beams form on the fluorescent screen of the color CRT.

Thus, according to the common electrostatic focusing lens formed by the common oblong opening surrounded by the upper rim 23, the lens has a short length in the longitudinal direction and a long length in the lateral direction such that the lens action in the longitudinal direction is strong. On the other hand, the lens action in the lateral direction is weak such that the beam after passing the lens comes to have a different ratio of lengths between longitudinal and lateral directions and have a more laterally elongated shape. The electron beam further distorts into a most laterally elongated shape due the deflection aberration of deflection yoke. Thus, the arrangement of slanted enlarging electrodes 20 and 21 to the first and second accelerating and focusing electrodes 18 and 19 brings the function of a supplementary electrostatic lens for compensating the lateral elongation of the electron beam.

As shown in FIGS. 5(A) and 6(A), the three oblong electron beam holes of the slanted enlarging electrode 20 have a ratio of the longitudinal length and the lateral width of 2:1 about the central hole 30*b* and 4:3 about the outer holes 30*a* and 30*c*, so that the electron beams passing the longitudinally oblong holes of the electrode 20 are subject to a weak focusing action in the longitudinal direction and a strong focusing action in the lateral direction to form a longitudinally oblong form of beams.

Thus, the laterally elongating action of the common electrostatic focusing lens formed by the common oblong opening surrounded by the upper rim 23 and the laterally elongating action from the deflection aberration are compensated to form screen small round beam spots of high density electron beams on the CRT and improves the resolution of the color picture CRT.

Besides, according to the electron gun of the present invention, the longitudinally oblong holes 30*a*, 30*b*, and 30*c* of the slanted electrode 20 perform solely the function of the supplementary electrostatic lens at the focusing electrodes 18 and 19 such that the shortening of the distance S among the three beams still gives enough action as the supplementary lens without influencing the function of the three electron beams from the action of the common electrostatic focusing lens regardless of the variation of the distance S.

The present invention therefore obtains a better concentration for three electron beams due to deflection by shortening the distance S among the beams and also greatly improves the focusing property of the electron gun by the electrostatic focusing lens enlarged to the bottom portion 28 of the slanted electrode 20 regardless of any variation of the distance S among the beams.

Furthermore, the supplementary electrostatic lens formed by the longitudinally oblong holes 30*a*, 30*b*, and 30*c* which are perforated across the bottom 28 to the slant portion 29 of the slanted electrode 20 are controlled for their accurate function by a longitudinal and lateral ratio and the difference in electrostatic lens action between the openings in the slant portion 29 and the bottom portion 28. For the electron gun of the present, the distance S among the electron beams of the slanted enlarging electrode 20 disposes at the first focusing electrode 18 and the second focusing electrode 19, and the dimension of the electron beam holes are determined from the action of the common electrostatic focusing lens of three beams enlarged from the rim 23 to the bottom 28.

For example, if an electron gun is placed in a tube neck of 29 mm diameter with the longitudinal opening of the upper rim 23 determined to have 8 mm in diameter, the distance S is set at 5 mm, the longitudinal direction diameter of the oblong hole of the electrode 20 is set at 8 mm, and the lateral direction diameters and set 4 mm for the central hole and 6 mm for the outer holes, respectively.

According to the present invention, the first and second accelerating and focusing electrodes 18 and 19 with the electrostatic focusing lens include an improved supplementary electrostatic lens construction such that the focusing of electron beams improves and the housing of the first and second focusing electrodes 18 and 19 within the restricted tube neck rather shortens the distance among the electron beams and effectively enlarges the diameter of the lens. Thus, the present invention provides a high quality electron gun.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An electron gun for a color picture cathode-ray tube, which comprises:

an electron beam formative region for emitting three electron beams, said electron beam formative region including cathode emitting electrons fixed on a cathode support wherein the electrons are emitted from a heater located in the cathode, and a first grid electrode and a second grid electrode for controlling the amount of actuate function of said electrons, and an electrostatic focusing lens for focusing said three electron beams, said electrostatic focusing lens including a first accelerating, focusing electrode and a second accelerating, focusing electrode for reducing the spherical aberration and the magnification of the said electrostatic focusing lens, said first accelerating, focusing electrode and said second accelerating, focusing electrode having their openings facing each other and containing a rim extended from an outer wall and having an oblong hole, a slanting enlarging aperture electrode located in said outer wall, said slanting enlarging aperture electrode having a longitudinally oblong center hole of a longitudinal cross section larger than a lateral cross section, two longitudinally elongated semi-hexagonal outer end portions of the longitudinal cross section being larger than the lateral cross section of said semi-hexagonal outer end portions, two electrode connecting portions in parallel to said outer wall, and two side slant portions narrowing down to a bottom portion extended from two head portions and said two electrode connecting portions, whereby a laterally oblong hole is formed by said rim and three longitudinally oblong holes, and said electron beam formative region and said electrostatic focusing lens are fixed on the head glass, respectively.

2. The electron gun of claim 1, wherein the slanting enlarging aperture electrode further has oblong hole portions disposed at side slant portions extended from the bottom portion.

* * * * *